US010464337B2

(12) United States Patent
Miyazaki

(10) Patent No.: US 10,464,337 B2
(45) Date of Patent: Nov. 5, 2019

(54) LIQUID DISCHARGE UNIT AND IMAGE FORMING APPARATUS

(71) Applicant: Yohei Miyazaki, Kanagawa (JP)

(72) Inventor: Yohei Miyazaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/103,814

(22) Filed: Aug. 14, 2018

(65) Prior Publication Data

US 2019/0224982 A1 Jul. 25, 2019

(30) Foreign Application Priority Data

Jan. 19, 2018 (JP) ..... 2018-007083

(51) Int. Cl.
*B41J 2/175* (2006.01)
*B41J 2/18* (2006.01)

(52) U.S. Cl.
CPC ..... *B41J 2/17596* (2013.01); *B41J 2/17563* (2013.01); *B41J 2/18* (2013.01)

(58) Field of Classification Search
CPC ..... B41J 2/17596; B41J 2/17563; B41J 2/17566; B41J 2/18; B41J 2/19
See application file for complete search history.

(56) References Cited

U.S. PATENT DOCUMENTS

| | | | | |
|---|---|---|---|---|
| 5,943,078 | A * | 8/1999 | Nishimoto et al. | 347/89 |
| 7,416,293 | B2 * | 8/2008 | Langford et al. | 347/89 |
| 2010/0194801 | A1 * | 8/2010 | Hibi | 347/9 |
| 2011/0221801 | A1 | 9/2011 | Igarashi | |
| 2015/0336387 | A1 | 11/2015 | Miyazaki | |
| 2018/0134033 | A1 | 5/2018 | Sawase | |

FOREIGN PATENT DOCUMENTS

| | | |
|---|---|---|
| JP | 2005-028675 | 2/2005 |
| JP | 2011-121344 | 6/2011 |
| JP | 2011-156859 | 8/2011 |
| JP | 2011-189615 | 9/2011 |
| JP | 2016-000516 | 1/2016 |
| JP | 2017-001298 | 1/2017 |
| JP | 2018-083413 | 5/2018 |

* cited by examiner

*Primary Examiner* — Juanita D Jackson
(74) *Attorney, Agent, or Firm* — Duft & Bornsen, PC

(57) ABSTRACT

A liquid discharge unit includes a main tank to accommodate a liquid, a liquid discharge head to discharge the liquid, a sub tank to supply the liquid to the liquid discharge head, a first liquid supply channel connecting the main tank and the sub tank, a second liquid supply channel connecting the sub tank and the liquid discharge head, a selector valve disposed in the second liquid supply channel, a liquid return channel connecting the selector valve and the main tank, a first pump disposed in the first liquid supply channel to feed the liquid from the main tank to the sub tank, and a second pump disposed in the liquid return channel to feed the liquid from the sub tank to the main tank.

9 Claims, 13 Drawing Sheets

HEAD DISCHARGE STATE

HEAD DISCHARGE STOP

HEAD DISCHARGE STATE

LIQUID DISCHARGE UNIT AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-007083, filed on Jan. 19, 2018, in the Japan Patent Office, the entire disclosure of which is incorporated by reference herein.

BACKGROUND

Technical Field

The present disclosure relates to a liquid discharge unit including a liquid discharge head that discharges a liquid, and an image forming apparatus including the liquid discharge unit.

Related Art

Output devices such as image forming apparatuses using an inkjet method adopt a rigorous technology of discharging an ink (droplets) in several picoliters through ink discharge ports (nozzles) in tens of microns. Therefore, in the case where the condition of the ink or the nozzles deteriorates, the droplets do not fly straight or non-discharge is more likely to occur.

For example, when a water-repellent film around the nozzles deteriorates, removal of the ink from the deteriorated portion becomes difficult. The remaining ink dries and blocks the nozzles, which causes discharge failure. Although there are many other factors that cause the discharge failure, one of the factors is nozzle clogging due to sedimentation and agglomeration of a precipitated ink.

Further, the color material used for enhancing the whiteness and concealing properties of a white ink in the inkjet apparatus has a large specific gravity and is sometimes easily settled. In the case of using such an ink in the inkjet apparatus, when the inkjet apparatus is left for a certain period of time, the contained coloring material is unevenly agglomerated and settled in a supply channel or in a supply module. In a recording head including the nozzles, the nozzles are clogged to cause non-discharge, or printing with a uniform image density becomes difficult even if the ink is dischargeable, which become causes of streaks and banding.

SUMMARY

In an aspect of this disclosure, a novel liquid discharge unit includes a main tank to accommodate a liquid, a liquid discharge head to discharge the liquid, a sub tank to supply the liquid to the liquid discharge head, a first liquid supply channel connecting the main tank and the sub tank, a second liquid supply channel connecting the sub tank and the liquid discharge head, a selector valve disposed in the second liquid supply channel, a liquid return channel connecting the selector valve and the main tank, a first pump disposed in the first liquid supply channel to feed the liquid from the main tank to the sub tank, and a second pump disposed in the liquid return channel to feed the liquid from the sub tank to the main tank.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
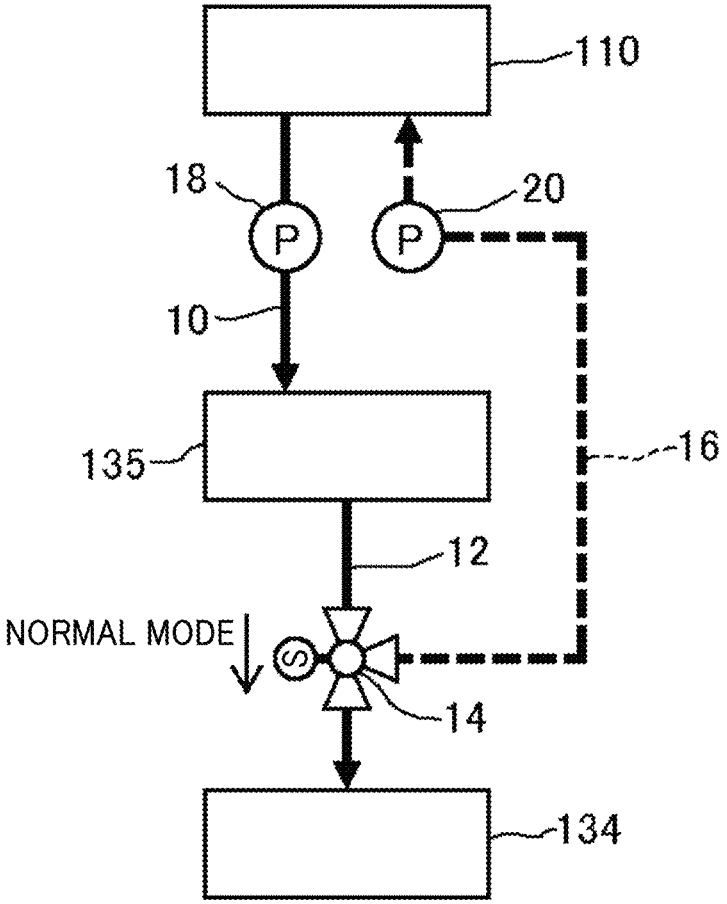
FIG. 1 is a schematic view illustrating a configuration of an ink supply channel and an ink circulation channel of a liquid discharge unit according to the present embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of the present specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of the present disclosure will be described with reference to the drawings. Note that at least one recording head exists corresponding to each color of an inkjet recording apparatus, a head tank that is a sub tank for supplying an ink of a color corresponding to each recording head is attached to the each recording head or is commonly attached to liquid discharge heads for the same color, and an ink cartridge that is a main tank for supplying the ink of the color appropriate for the head tank is provided to each head tank or is commonly provided to head tanks for the same color. However, hereinafter, to facilitate the understanding, one recording head, one head tank, and one ink cartridge will be described and illustrated.

As illustrated in FIG. 1, in a liquid discharge unit for inkjet recording apparatus, which is a liquid discharge unit according to an embodiment of the present disclosure, a first ink supply channel 10 for supplying an ink of a predetermined color to a head tank (sub tank) 135 that temporarily stores the ink is provided between an ink cartridge 110 as a main tank that accommodates the ink as a liquid and the head tank 135 as a sub tank, and a second ink supply channel 12 for supplying the ink to a recording head 134 that is a liquid discharge head is provided between the head tank 135 and the recording head 134. A first selector valve 14 of three-way valve (three-port electromagnetic valve) that is a first selector valve is provided in the middle of the second ink supply channel 12, and an ink return channel 16 branched from the second ink supply channel 12 and coupled to the ink cartridge 110, using one of the three ports, is formed. The first selector valve 14 can be provided immediately after an outlet port of the head tank 135. A supply pump 18 that is a first pump capable of feeding the liquid from the ink cartridge 110 toward the head tank 135 is provided in the first ink supply channel 10, and a circulation pump 20 that is a second pump capable of feeding the liquid from the head tank 135 toward the ink cartridge 110 is provided in the ink return channel 16. This circulation pump can be installed upstream of the first selector valve 14 in the second ink supply channel, instead of in the ink return channel if space allows between the head tank and the recording head.

Thus, the liquid discharge unit includes a main tank 110 to accommodate a liquid, a liquid discharge head 134 to discharge the liquid, a head tank (sub tank) 135 to supply the liquid to the liquid discharge head 134, a first liquid supply channel 10 connecting the main tank 110 and the head tank (sub tank) 135, a second liquid supply channel 12 connecting the head tank (sub tank) 135 and the liquid discharge head 134, a first selector valve 14 disposed in the second liquid supply channel 12, a first liquid return channel 16 connecting the first selector valve 14 and the main tank 110, a first pump 18 disposed in the first liquid supply channel 10 to feed the liquid from the main tank 110 to the head tank (sub tank) 135, and a second pump 20 disposed in the first liquid return channel 16 to feed the liquid from the head tank (sub tank) 135 to the main tank 110.

A serial machine such as a flatbed, desktop, or wide format printer (a printer that reciprocates a recording head while conveying a recording material to print one line at a time), or a line machine (a printer that perform printing in a non-scanning manner in a main scanning direction using a recording head having a paper width) can be applied to the configuration of the present supply system, regardless of the format of the inkjet apparatus.

With the configuration to branch the ink return channel from the second ink supply channel, in the process to supply the ink from the ink cartridge to the head tank and from the head tank to the recording head, sedimentation or sedimentary particles of the ink can be agitated, that is, the ink in the whole ink supply system can be agitated to make concentration fluctuation as ink small, whereby the sedimentation or sedimentary particles can be prevented from being supplied to the recording head. Further, the ink in the second ink supply channel is agitated, as compared with a configuration to have the ink return channel as an independent channel of the second ink supply channel connecting the head tank and the recording head (in other words, a configuration to form the ink return channel between the ink cartridge and the head tank).

In the inkjet apparatus, when impurities are mixed in the ink, discharge failure is caused. Note that, in the case where the recording head has a flow-through function, the ink is circulated through a common liquid chamber and individual liquid chambers inside the head, and air bubbles in the ink can be discharged by circulated ink convection. Therefore, discharge failure due to the air bubbles in the ink is less likely to occur, and this configuration is relatively tolerant to the air bubbles and dust in the ink and entrainment of the air bubbles through nozzles (ink discharge ports). However, in the case where the recording head does not have the flow-through function, the ink cannot be circulated inside the head. Therefore, a degassing module (degassing Md) for removing the air bubbles in the ink and a filter for removing the dust in the ink need to be provided upstream of the recording head.

Figure 2:
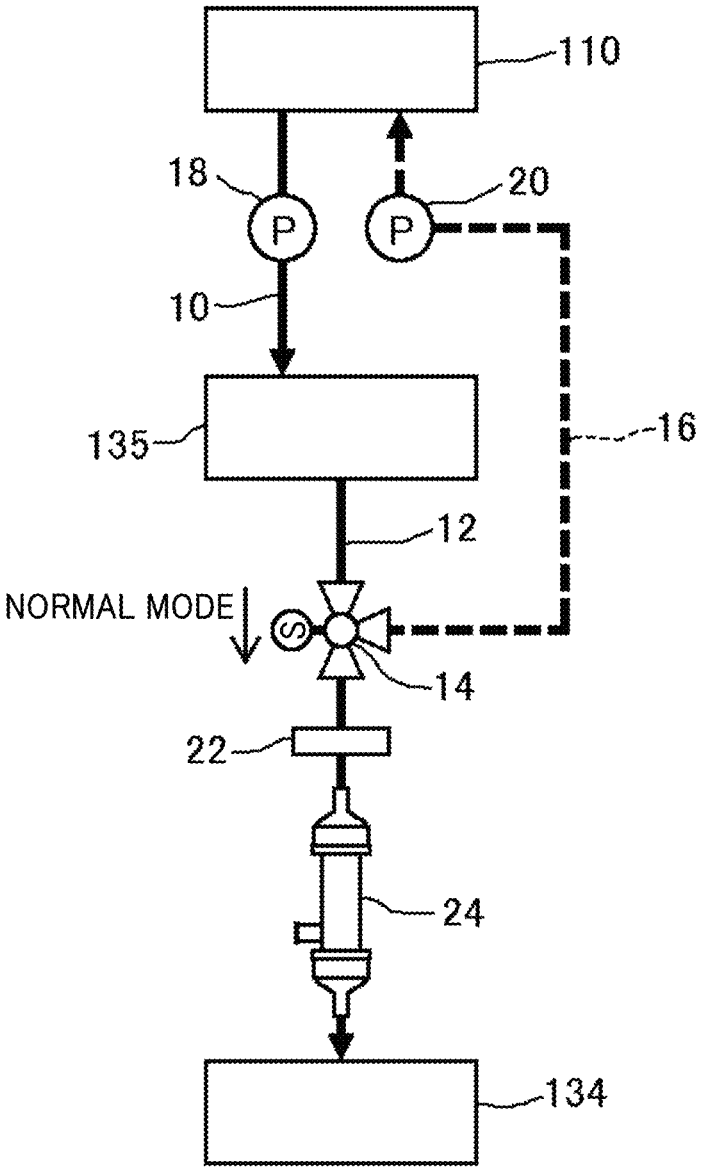
FIG. 2 is a schematic view for describing a positional relationship among the ink circulation channel, a filter, and a degassing module.

FIG. 2 illustrates the present embodiment in an ink supply system including such a filter and a degassing Md. Note that the same reference numeral is given to a configuration common to the embodiment illustrated in FIG. 1, and description thereof is omitted.

The first selector valve 14 that creates the ink return channel 16 is disposed upstream of a filter 22 and a degassing Md 24 to prevent occurrence of clogging of the filter 22 and the degassing Md 24 due to sedimentation or agglomeration particles. That is, the filter 22 and the degassing Md 24 are located closer to the recording head than the first selector valve 14 is, that is, on the downstream side of the first selector valve 14 in a direction in which the liquid is fed from the head tank (sub tank) 135 to the liquid discharge head 134. With such a configuration, the sedimentation or sedimentary particles being carried to the filter 22 and the degassing Md 24 can be suppressed. On the other hand, in the configuration using the ink return channel 16 and the circulation pump 20, air bubbles are easily entrained depending on a pump flow rate or a circulation channel of an agitation process. Therefore, an effect obtained by installation of the filter 22 and the degassing Md 24 immediately before an inflow port of the recording head 134 is large.

Thus, the liquid discharge unit includes the filter 22 disposed downstream of the first selector valve 14 in the second liquid supply channel 12 and a degassing module (degassing Md) 24 disposed downstream of the first selector valve 14 in the second liquid supply channel 12 in a direction in which the liquid is fed from the head tank (sub tank) 135 to the liquid discharge head 134.

Next, an embodiment to positively move the entire ink in the supply system to agitate the ink will be described. This embodiment makes the sedimentary particles of the ink in the cartridge/tank actively and easily flow out, as a configuration not to cause a place where no flow occurs (stagnation). Corners of the ink cartridge and corners of the head tank can be considered to be most stagnated, and further, the sedimentary particles of the ink are easily aggregated on a bottom of the cartridge/tank.

Figure 3A:
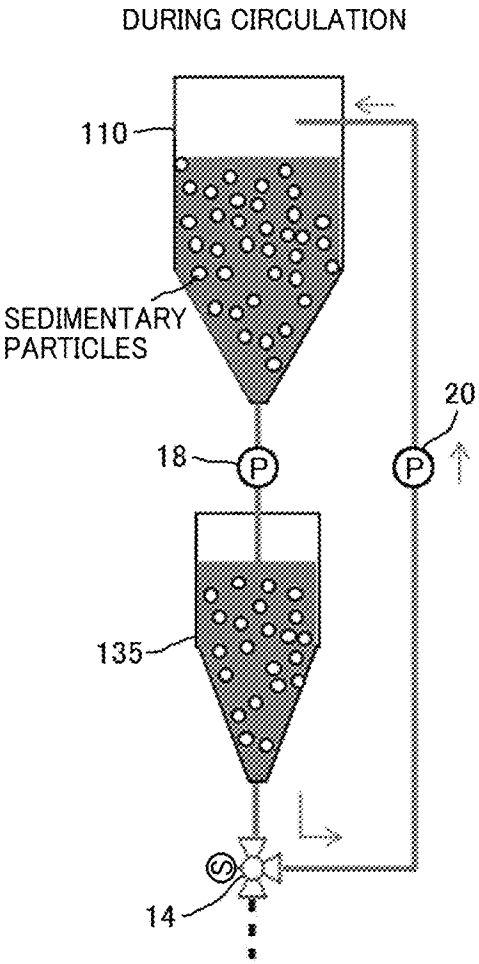
FIGS. 3A to 3C are schematic views of an example of a tank in the liquid discharge unit according to the present embodiment.
Figure 3B:
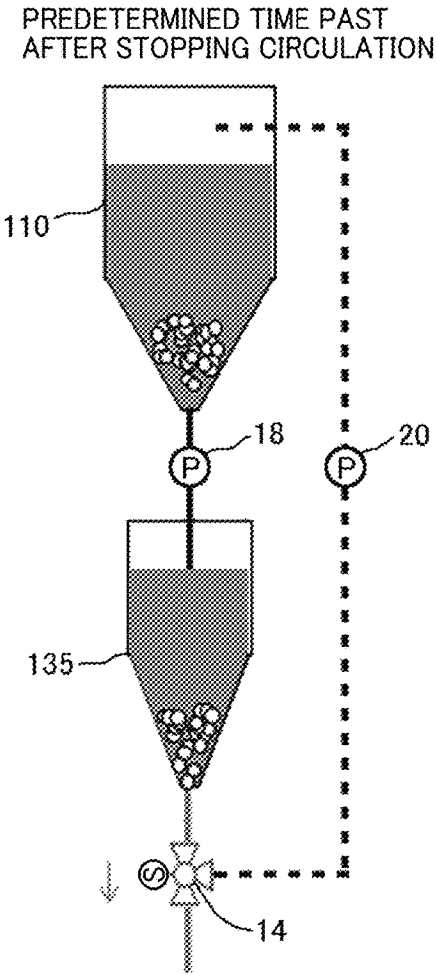
Figure 3C:
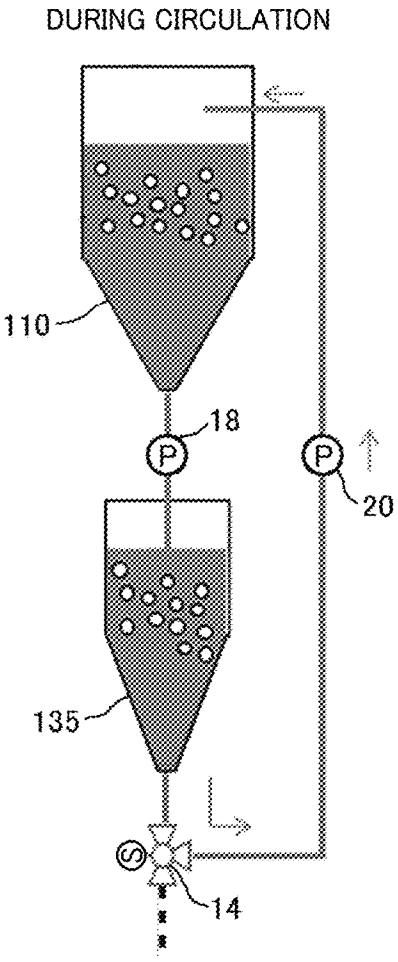

FIGS. 3A through 3C illustrate the present embodiment to specify shapes of the ink cartridge and the head tank and a connecting position of the ink supply channel. Note that the same reference numeral is given to a configuration common to the embodiment illustrated in FIG. 1 and description thereof is omitted. Further, illustration of the ink supply channel and the recording head after the three-way valve is omitted.

The ink cartridge 110 and the head tank 135 are narrowed downward, and outflow ports are provided in respective lowermost ends. FIG. 3A illustrates a state in which the ink is circulated. FIG. 3B illustrates a state in which the circulation is stopped, the ink is sent to the recording head 134, and a fixed time has passed. The sedimentary particles are aggregated in respective lower portions of the ink cartridge 110 and the head tank 135. FIG. 3C illustrates an initial state in which the ink is recirculated to eliminate the state of aggregation of the sedimentary particles in the central drawing. The sedimentary particles in the head tank 135 flows into and are spread in the ink cartridge 110, and the sedimentary particles in the ink cartridge 110 flows into and are spread in the head tank 135. With such a configuration, the sedimentation ink in the cartridge/tank can easily flow out of the cartridge/tank, and an agitation state can be easily made.

Thus, at least one of the main tank 110 and the sub tank 135 includes the outflow port having a funnel shape on a downstream end of the at least one of the main tank 110 and the sub tank 135 in a direction in which the liquid is fed from the ink cartridge (main tank) 110 or the head tank (sub tank) 134 to the liquid discharge head 135.

Figure 4A:
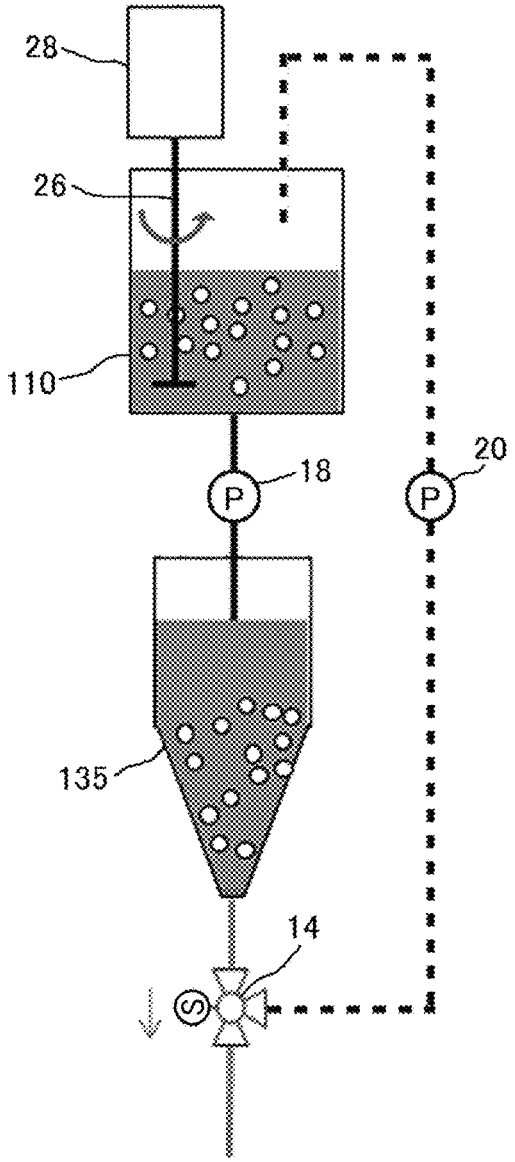
FIGS. 4A and 4B are schematic views of the tank including an agitating bar for agitating the liquid in the tank in the liquid discharge unit according to the present embodiment.
Figure 4B:
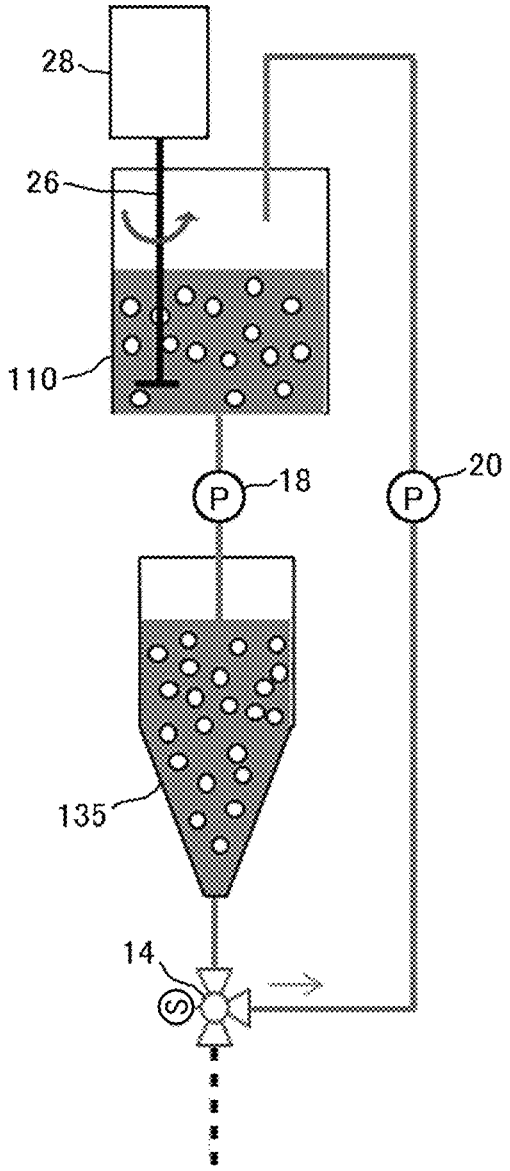

Next, another configuration to agitate the sedimentary particles or agglomeration particles is described. This configuration can be used alone or together with the above-described configuration with the tank shape. A mechanical agitation mechanism is assumed as the tank agitation mechanism, as illustrated in FIGS. 4A and 4B. An agitating bar 26 as an agitator is simply provided in the ink cartridge (main tank) 110, the agitating bar 26 is moved by a power source 28 on a constant basis or at each fixed time, an agitating operation is performed, and the sedimentary particles in the cartridge are agitated, to suppress agglomeration after sedimentation and adhesion to an inner wall of the cartridge. With the configuration, circulation time of the ink circulation can be shortened. In other words, downtime of a printing apparatus can be made small, which leads to improvement in productivity. The ink in the ink cartridge 110 can be agitated even during the ink is being discharged in the recording head as illustrated in FIG. 4A. However, the particles are gradually settled in the head tank 135. Therefore, after the elapse of a fixed time, a circulation operation is performed between the ink cartridge 110 and the head tank 135 as illustrated in FIG. 4B. At that time, the agitating operation in the cartridge may be stopped. By performing the circulation operation in this way, the agitated ink in the ink cartridge 110 flows into the head tank 135. Therefore, the particles can be dispersed without repeating the circulation many times.

Thus, at least one of the main tank 110 and the sub tank 135 includes the agitator (agitation bar 26) to agitate the liquid in the at least one of the main tank 110 and the sub tank 135.

Note that, in FIGS. 4A and 4B, the same reference numeral is given to a configuration common to the embodiment illustrated in FIG. 1 and description thereof is omitted. Further, illustration of the ink supply channel and the recording head after the three-way valve is omitted. In the illustrated example, the agitating bar is arranged in the ink cartridge. However, the agitating bar may be arranged in the head tank if size allows.

Figure 5:
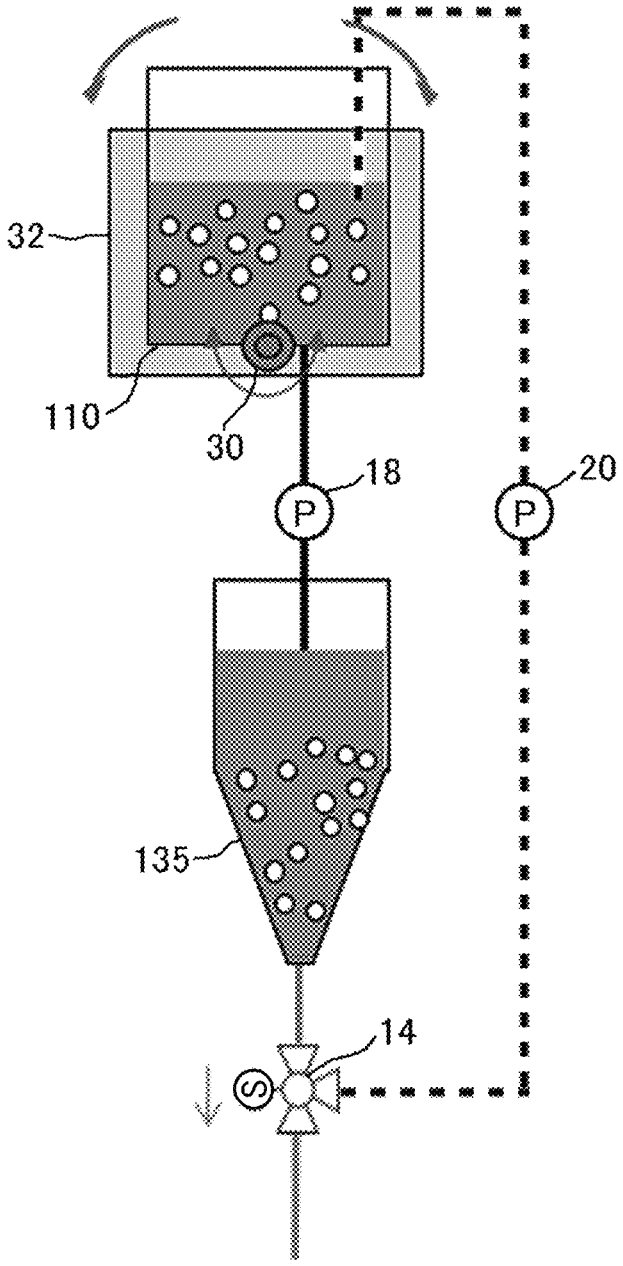
FIG. 5 is a schematic view illustrating a tank agitation mechanism different from FIGS. 4A and 4B.

FIG. 5 illustrates a tank agitation mechanism as another agitator. The ink cartridge 110 is secured to a holder 32 including a swing mechanism 30. The ink cartridge 110 is swung to agitate the ink inside the ink cartridge 110. In FIG. 5, the same reference numeral is given to a configuration common to the embodiment illustrated in FIG. 1, and illustration of the ink supply channel and the recording head after the three-way valve is omitted.

For example, in the case where a white ink is used in a plurality of liquid discharge heads, it is almost the case that the ink cartridge is commonly used and the head tank and following elements are required for each recording head. Therefore, if the circulation mechanism and the agitation mechanism in the tank are installed for the sedimentation-based ink, the increase in space and cost due to the agitation mechanism is small.

Figure 6:
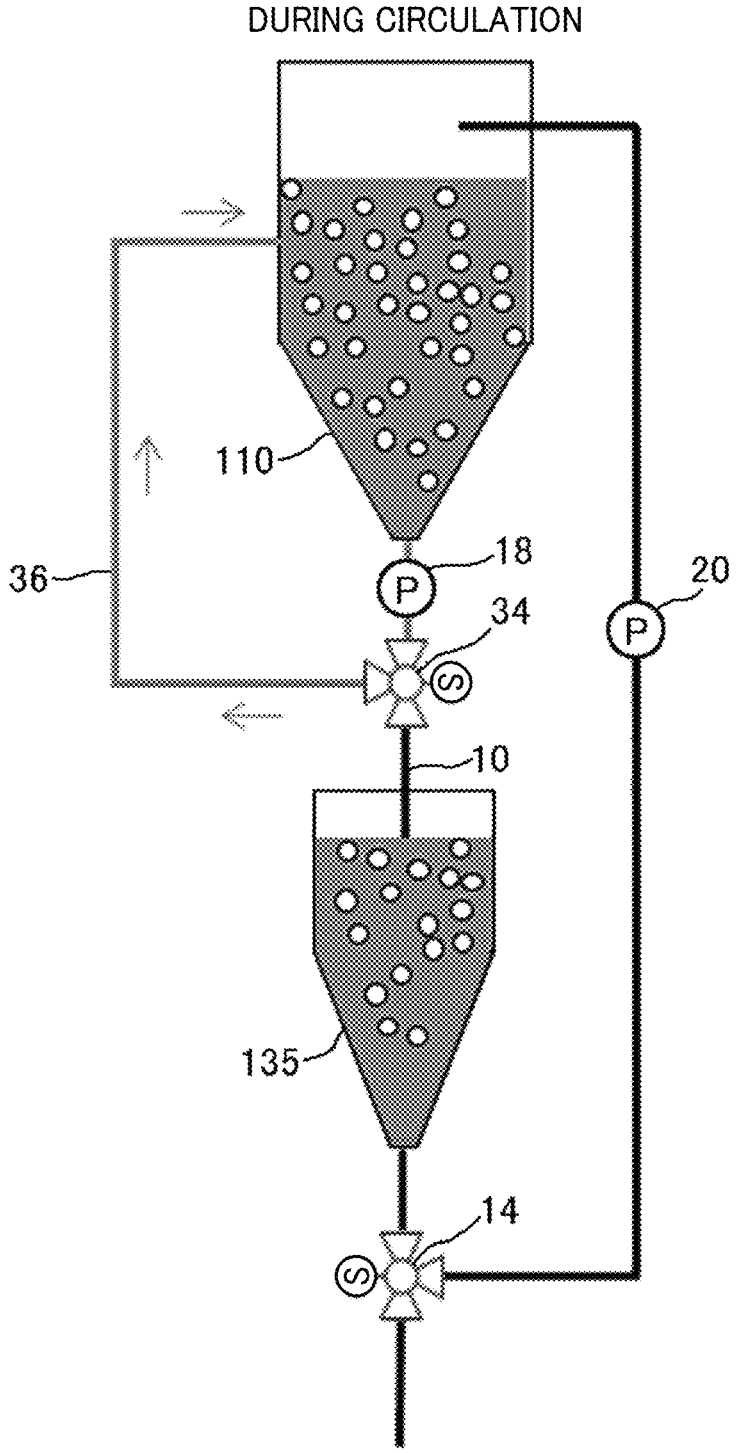
FIG. 6 is a schematic view illustrating an embodiment in which a configuration of individual circulation in a main tank is added.

Next, a configuration to agitate the ink, focusing on the sedimentation or sedimentary particles in the ink cartridge will be described. The configuration includes, as illustrated in FIG. 6, a second selector valve 34 of a three-way valve (three-port electromagnetic valve) that is a second selector valve provided downstream of the supply pump 18 of the first ink supply channel 10 in a direction in which the liquid is fed from the ink cartridge (main tank) 110 to the head tank (sub tank) 135 for supplying the ink from the ink cartridge 110 to the head tank 135 to form an ink return channel 36 dedicated for the cartridge, which is a second return channel branched from the first ink supply channel 10 using one of the three ports and connected to the ink cartridge 110. With the configuration, an individual circulation channel can be constructed for the ink cartridge that is the main tank. The ink is circulated and agitated in the circulation channel passing through the ink cartridge and the head tank after sufficiently agitated in the ink cartridge, whereby the circulation time in the entire circulation channel can be shortened. Note that, in FIG. 6, the same reference numeral is given to a configuration common to the embodiment illustrated in FIG. 1, and illustration of the ink supply channel and the recording head after the three-way valve in the second ink supply channel is omitted.

Thus, the liquid discharge unit includes the second selector valve 34 disposed downstream of the first pump 18 in the first liquid supply channel 10 in a direction in which the liquid is fed from the ink cartridge (main tank) 110 to the head tank (sub tank) 135, and a second liquid return channel 36 connecting the second selector valve 34 and the main tank 110.

The ink return channel dedicated for the cartridge is conceivably formed into a channel having both ends coupled to the ink cartridge, instead of one end branched from the first ink supply channel. However, agitation of the sedimentation or sedimentary particles in the ink supply channel can be reliably secured when used in conjunction with the configuration to agitate the sedimentation or sedimentary particles in the head tank, and reduction in the number of parts can also be achieved, which is favorable.

FIG. 7 and FIGS. 8A through 8E illustrate a specific operation sequence regarding the agitating operation of the sedimentary particles using the circulation channel will be described in the case of the ink channel illustrated in FIG. 1.

As illustrated in FIGS. 8A through 8E, the liquid discharge unit includes detectors 38 to detect a liquid amount in the sub tank 135 and the main tank 110. The first selector valve 14 is switched to open the first liquid return channel 16 and to close a channel from the first selector valve 14 to the liquid discharge head 134 in the second liquid supply channel 12.

The detectors 38 in the form of a float sensor (liquid level sensor) for detecting the ink amount (liquid amount) are provided in the ink cartridge 110 and the head tank 135, respectively.

First, the detectors 38 (float sensors) detect whether the ink amount (liquid level) in the ink cartridge 110 as the main tank is at a low level (51). When the ink amount is at the low level, a "no ink warning" is notified and the liquid discharge unit is transitioned to a "machine stop" state. In this state, the ink cartridge is replaced, or the ink is supplied to the ink cartridge according to the model.

Figure 8A:
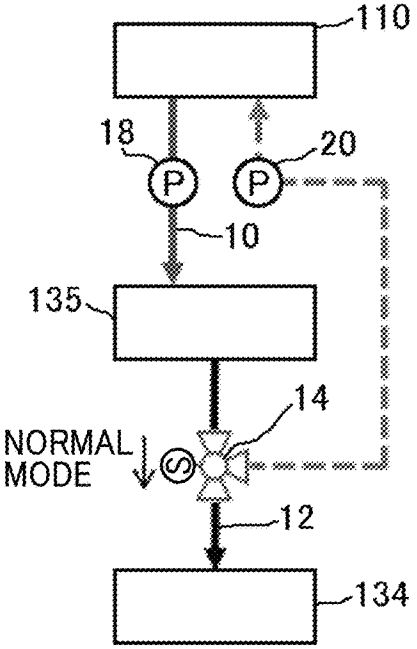
FIGS. 8A to 8E are schematic views of ink supply process and ink circulation process associated with the sequence of FIG. 7 and a state of a liquid level in the sub tank.
Figure 8B:
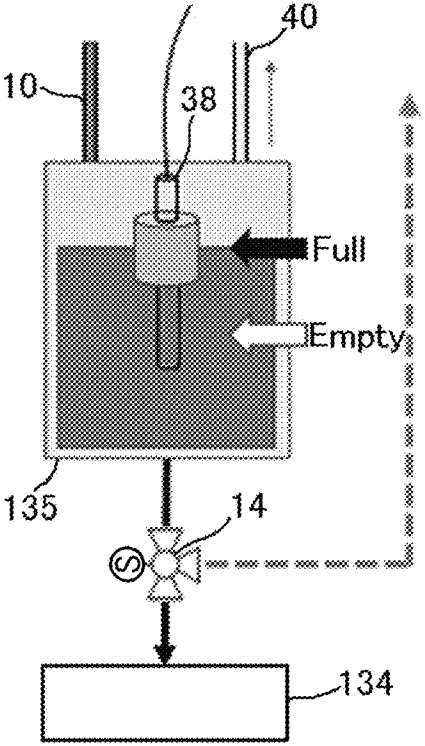

When the ink amount in the ink cartridge 110 has not decreased to the low level and the ink amount in the head tank 135 as the sub tank is at a low level/empty level (predetermined value) (S2), the supply pump 18 is turned on to fill the ink in the head tank 135 via the first ink supply channel 10 (S3) as illustrated in FIG. 8A. The supply pump 18 continues to be driven until the ink amount in the head tank 135 reaches a high level/full level as illustrated in FIG. 8B. An air channel 40 is attached to the head tank 135 to smoothly fill the ink, thereby to achieve pressure reduction.

Figure 8C:
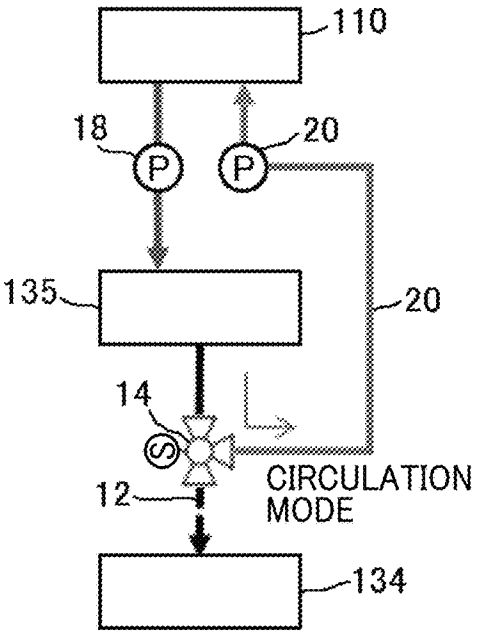

When the ink amount in the head tank 135 reaches the high level/full level (S4), the supply pump 18 is turned off (S5), that is, the supply of the ink from the ink cartridge 110 is stopped. Then, the first selector valve 14 (three-way valve) installed in the second ink supply channel 12 is switched to a circulation mode (S6), the circulation pump 20 installed in the ink return channel 16 is turned on (S7) as illustrated in FIG. 8C, the ink is fed from the head tank 135 to the ink cartridge 110, and the pump 20 continues to be driven until the ink amount in the head tank 135 reaches the low level/empty level (FIG. 8D).

Figure 8E:
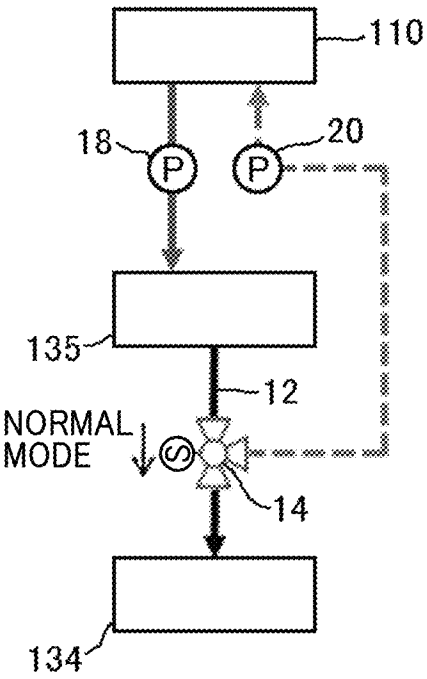
Figure 8D:
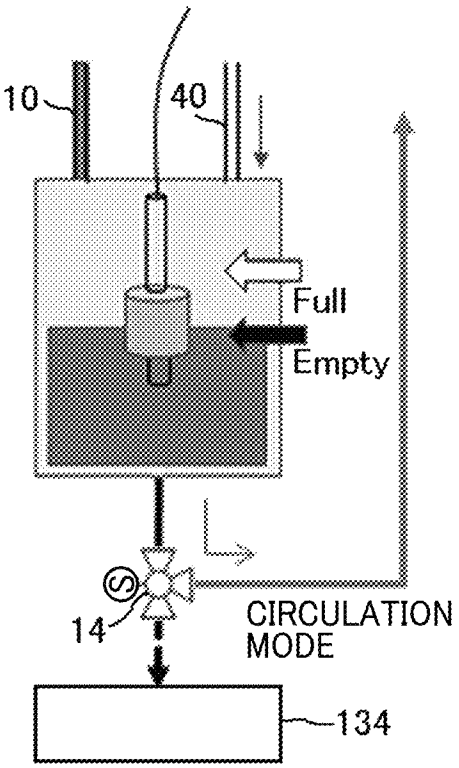

When the ink amount in the head tank 135 reaches the low level/empty level (S8), the circulation pump 20 is turned off (S9), and the first selector valve 14 (three-way valve) installed in the second ink supply channel 12 is switched to a normal mode (S10) as illustrated in FIG. 8E. After the ink amount in the head tank 135 has reached the low level/empty level, the circulation pump may be kept on until a predetermined time determined by a user through a user interface passes, for example, and then turned off.

Then, when the cumulative number of circulation operations of the on/off of the supply pump, switching of the three-way valve (electromagnetic valve), and on/off of the circulation pump from S2 to S10 reaches a predetermined number (threshold) (S11), the ink circulation sequence is terminated. With the operations, the sedimentation portion of the ink stored in the ink cartridge 110 and the head tank 135 is agitated.

Figure 7:
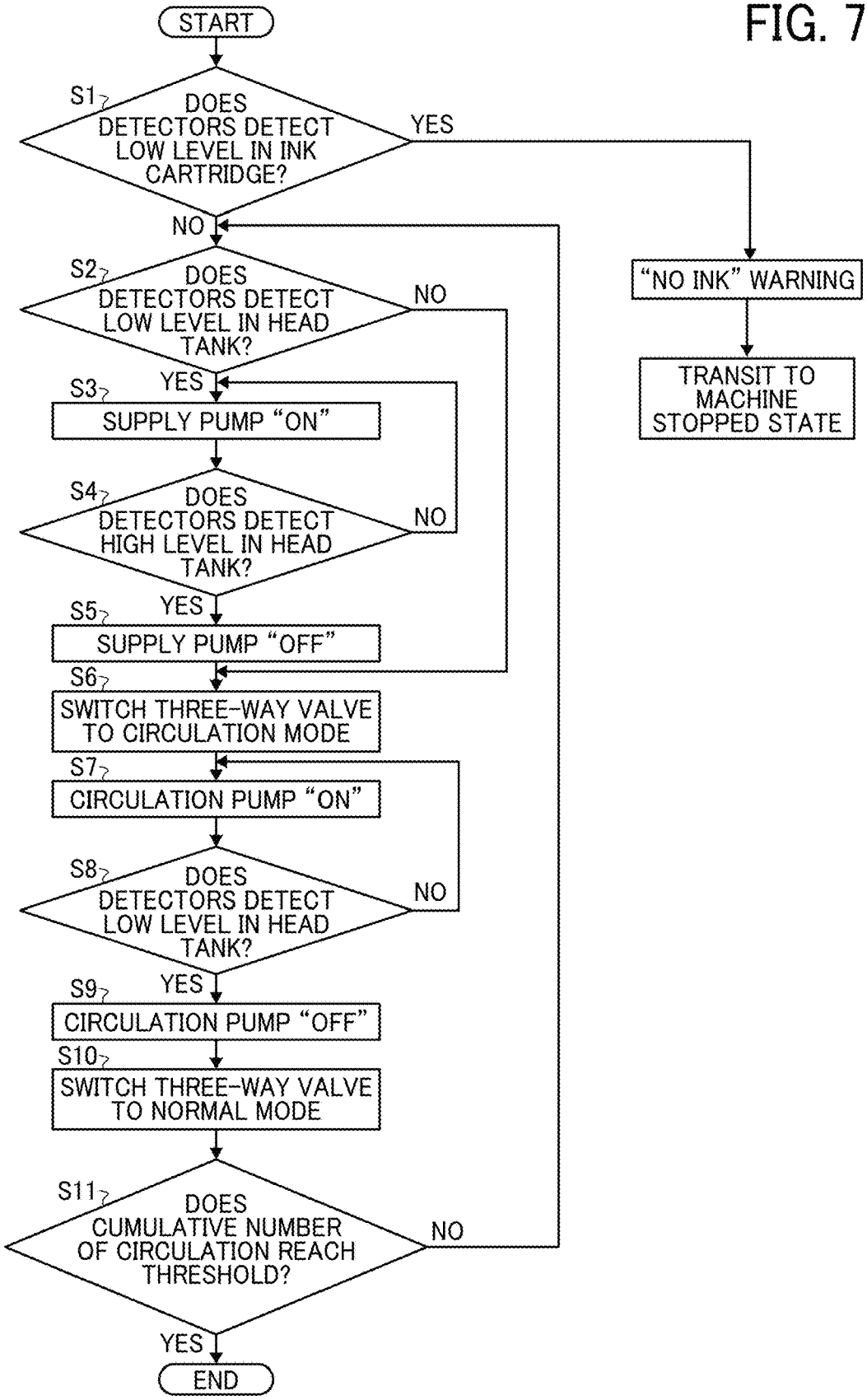
FIG. 7 is a flowchart illustrating a sequence of an ink circulation operation.

Note that, in the case of the configuration (the example in FIG. 6) to integrally circulate the ink in the ink cartridge 110 and the head tank 135 and to circulate the ink in the ink cartridge 110, the ink in the ink cartridge 110 can be efficiently agitated and circulated by driving the supply pump 18, setting the second selector valve 34 installed in the first ink supply channel 10 to the circulation mode, in the normal mode to supply the ink from the head tank 135 to the recording head 134, separately from the timing to circulate the ink in the ink cartridge 110 and the head tank 135 in the ink circulation sequence in FIG. 7.

Figure 9B:
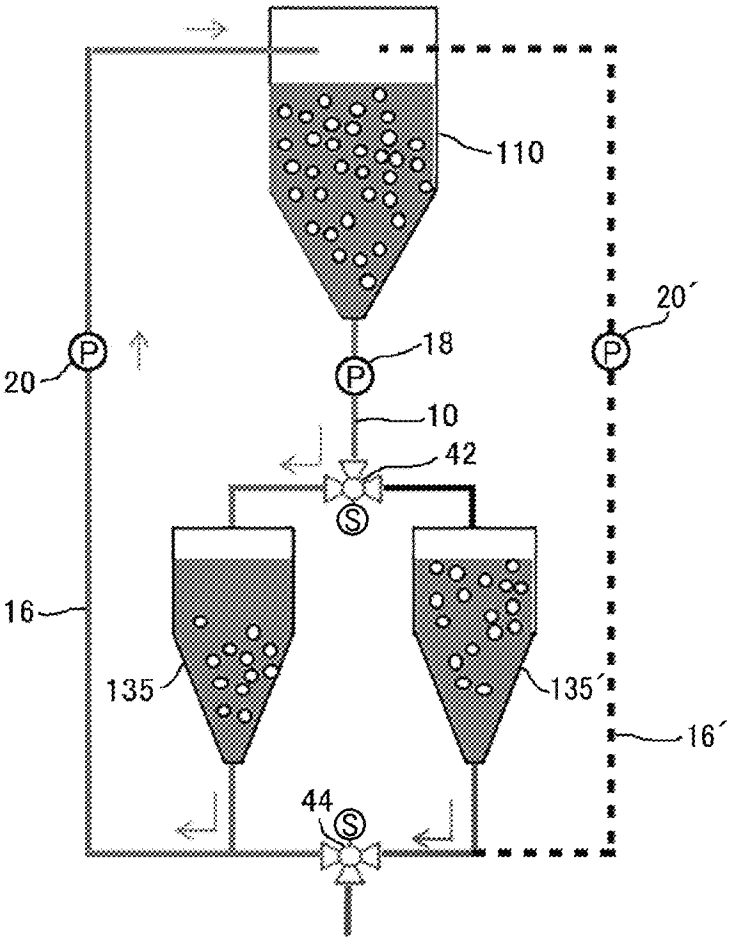
FIGS. 9A and 9B are schematic views of ink supply process and ink circulation process in a case of a one-color two-head configuration.
Figure 9A:
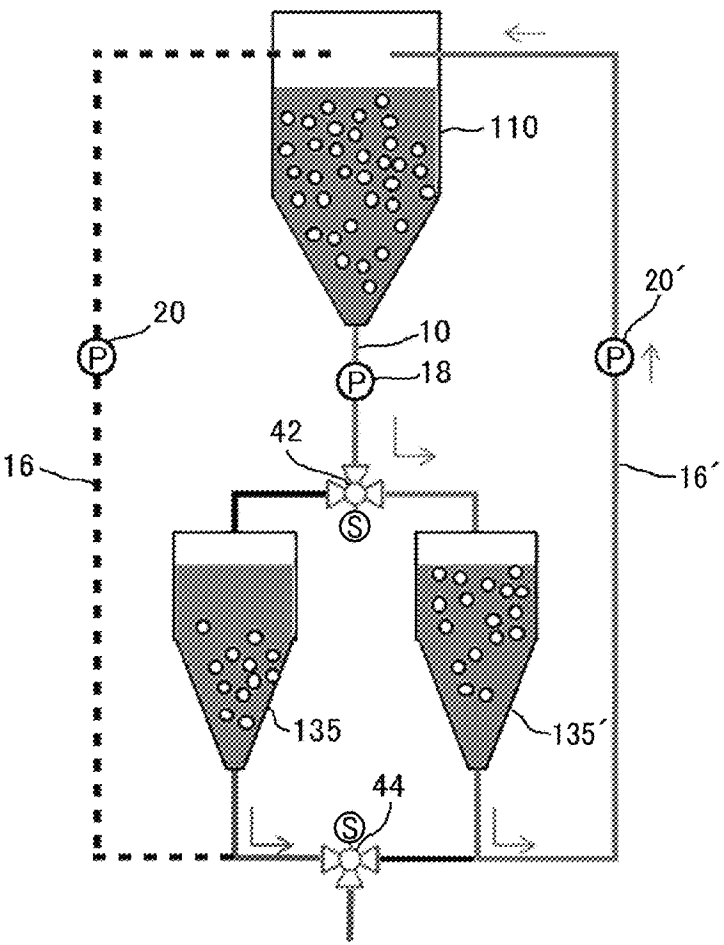

In the case of medium-sized or larger inkjet apparatuses, the number of liquid discharge heads tends to increase as an object to be sprayed gets larger. At least the head tanks of more than the number of ink types are required. As described in the beginning of the present section, to facilitate the understanding, the above embodiments have been described and illustrated with one recording head, one head tank, and one ink cartridge. However, in the case of a one-color two-head configuration in which the head tank is provided for each recording head, for example, a three-way valve (three-port electromagnetic valve) 42 that is a third selector valve is installed downstream of the supply pump 18 of the first ink supply channel 10 in a direction in which the liquid is fed from the ink cartridge (main tank) 110 to the head tank (sub tank) 135, and two of three ports of the three-way value 42 are connected to head tanks 135 and 135', respectively, as illustrated in FIG. 9. Then, ink return channels 16 and 16' are formed for the head tanks 135 and 135', and a third selector valve 44 (three-way valve) is installed in a common liquid supply channel (common channel) connecting the head tanks 135 and 135' and leading to the ink return channels 16 and 16' is installed, and one of the three ports is connected to the two liquid discharge heads, whereby discharge and circulation can be performed in parallel. By doing so, one head tank is in an ink circulation state while securing a discharge state where the other head tank is connected to two liquid discharge heads, whereby no downtime due to ink circulation occurs.

Thus, the liquid discharge unit includes the third selector valve 42 disposed downstream of the first pump 18 in the first liquid supply channel 10 in a direction in which the liquid is fed from the ink cartridge (main tank) 110 to the head tank (sub tank) 135 and 135'. The third selector valve 44 includes a plurality (two in FIGS. 9A and 9B) of ports, one of which is connected to the first pump 18. A plurality (two in FIGS. 9A and 9B) of sub tanks 135 and 135' respectively connected to remaining of the plurality of ports of the third selector valve 44. The common liquid supply channel connects the plurality of sub tanks 135 and 135' and the first selector valve 44.

Figure 10:
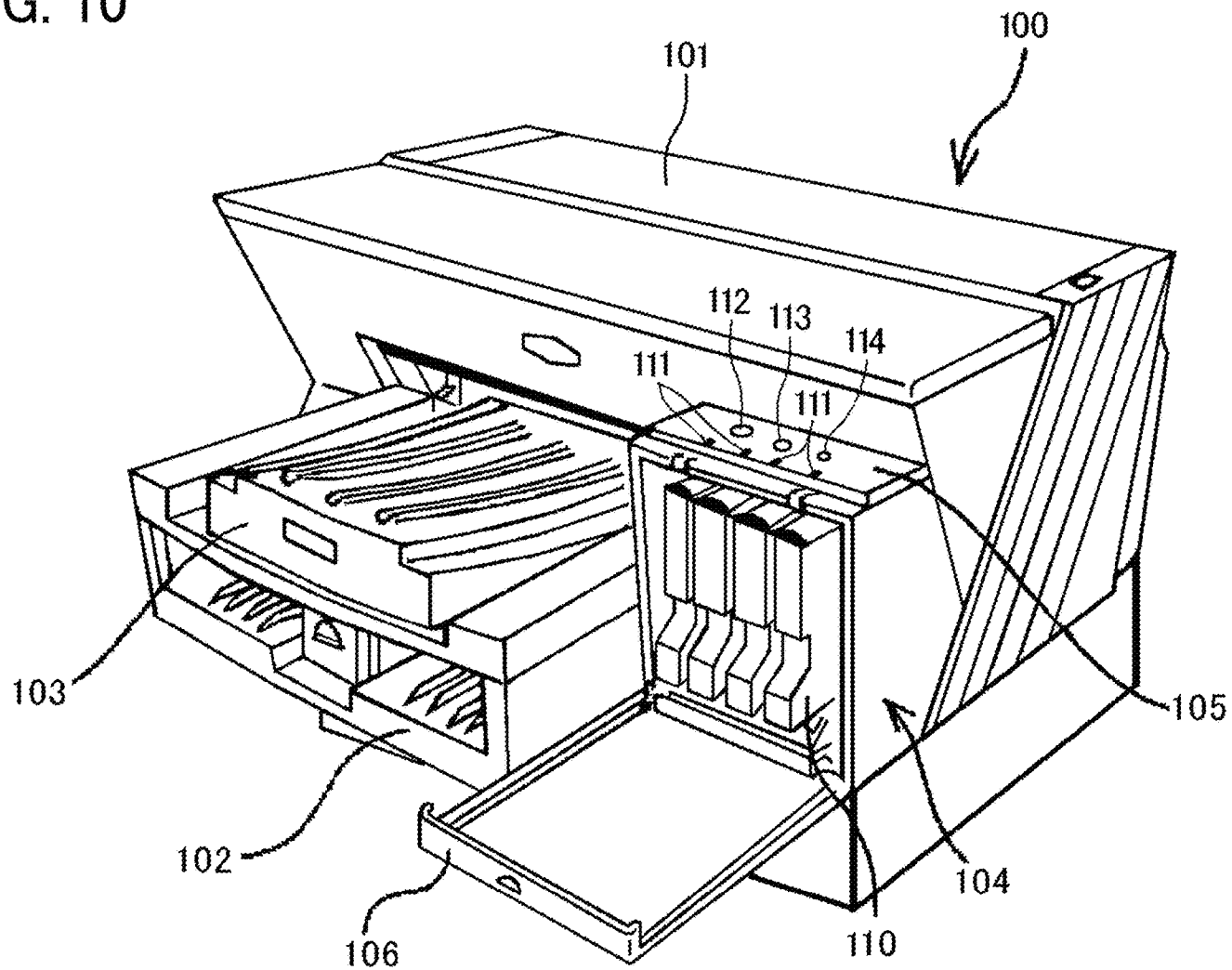
FIG. 10 is a perspective view of an inkjet recording apparatus as an example of an image forming apparatus according to the present embodiment.

Next, an embodiment of an inkjet recording apparatus will be described as an example of an image forming apparatus according to the present embodiment on which the above-described liquid discharge unit is mounted. FIG. 10 is a perspective view of the inkjet recording apparatus as obliquely seen from the front. An inkjet recording apparatus 100 illustrated in FIG. 10 includes an apparatus body 101, a paper feed tray 102 for loading paper mounted in the apparatus body 101, and a paper ejection tray 103 for storing image-formed recording papers detachably mounted to the apparatus body 101. A cartridge loader 104 for loading an ink cartridge is provided adjacent to a paper feed/ejection tray portion, on one side of a front surface of the apparatus body 101. An operation/display 105 on which an operation button and a display are arranged is provided on an upper surface of the cartridge loader 104.

Four ink cartridges 110 are set in the cartridge loader 104. The ink cartridges 110 store recording liquids (inks) that are color materials of different colors, such as black (K), cyan (C), magenta (M), and yellow (Y). The ink cartridges 110 can be loaded by being inserted from the front side toward the rear side of the apparatus body 101 and are loaded side by side in a lateral direction in a vertically placed state. A front cover (cartridge cover) 106 that opens when the ink cartridge 110 is attached or detached is provided in an openable/closable manner on a front side of the cartridge loader 104.

Four remaining amount indicators 111 for displaying that the remaining amounts of the ink cartridges of the respective colors are close to end or end are arranged corresponding to loading positions (array order) of the ink cartridges 110 of the respective colors on the operation/display 105. Further, a power button 112, a paper feed/print restart button 113, and a cancel button 114 are arranged on the operation/display 105.

Figure 11:
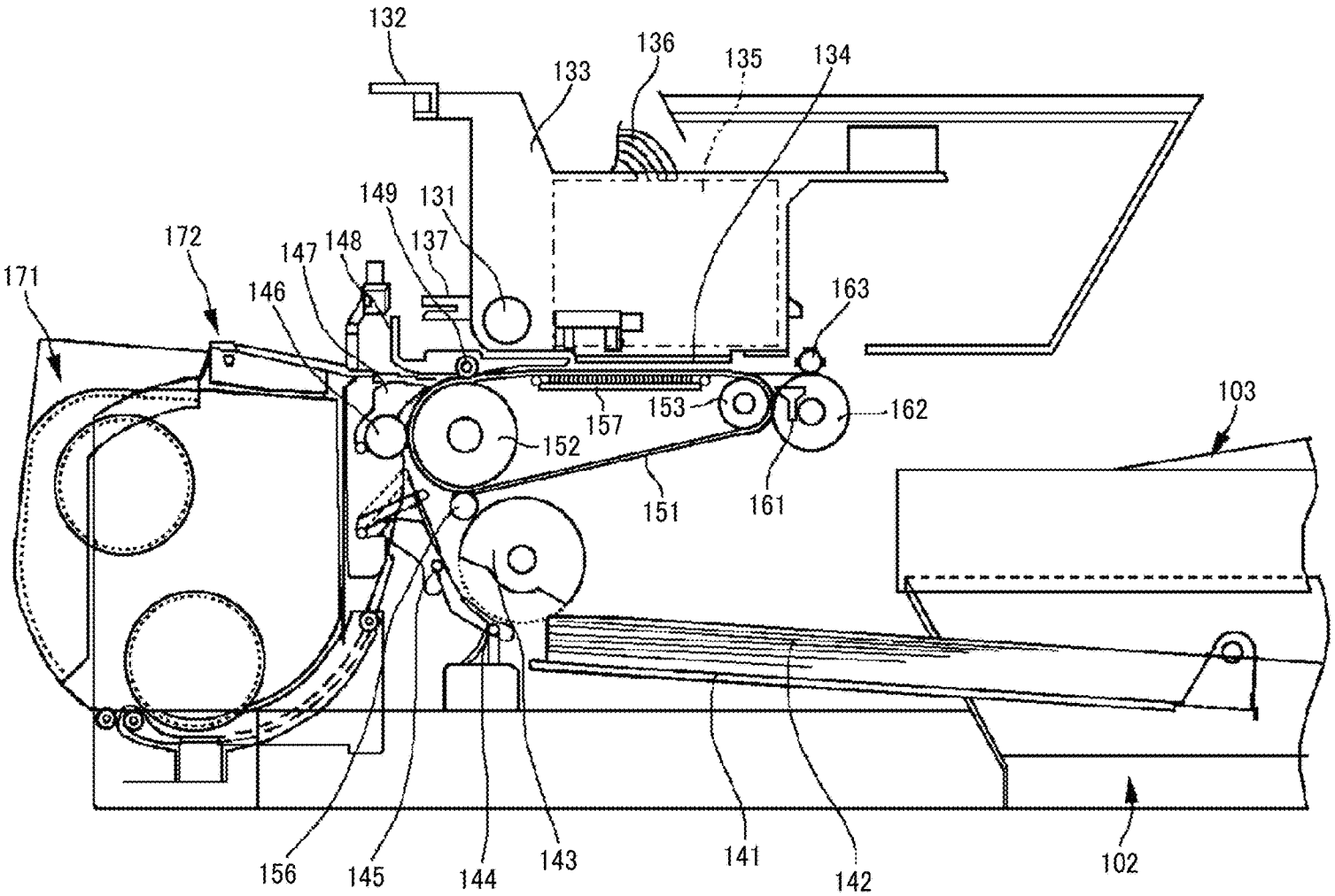
FIG. 11 is a schematic cross-sectional side view illustrating a mechanism portion of the inkjet recording apparatus of FIG. 10.

Next, the mechanism portion of the inkjet recording apparatus will be described referring to FIGS. 11 and 12. Note that FIG. 11 is a side view illustrating an outline of the mechanism portion, and FIG. 12 is a plan view of a principal portion of the mechanism portion.

Figure 12:
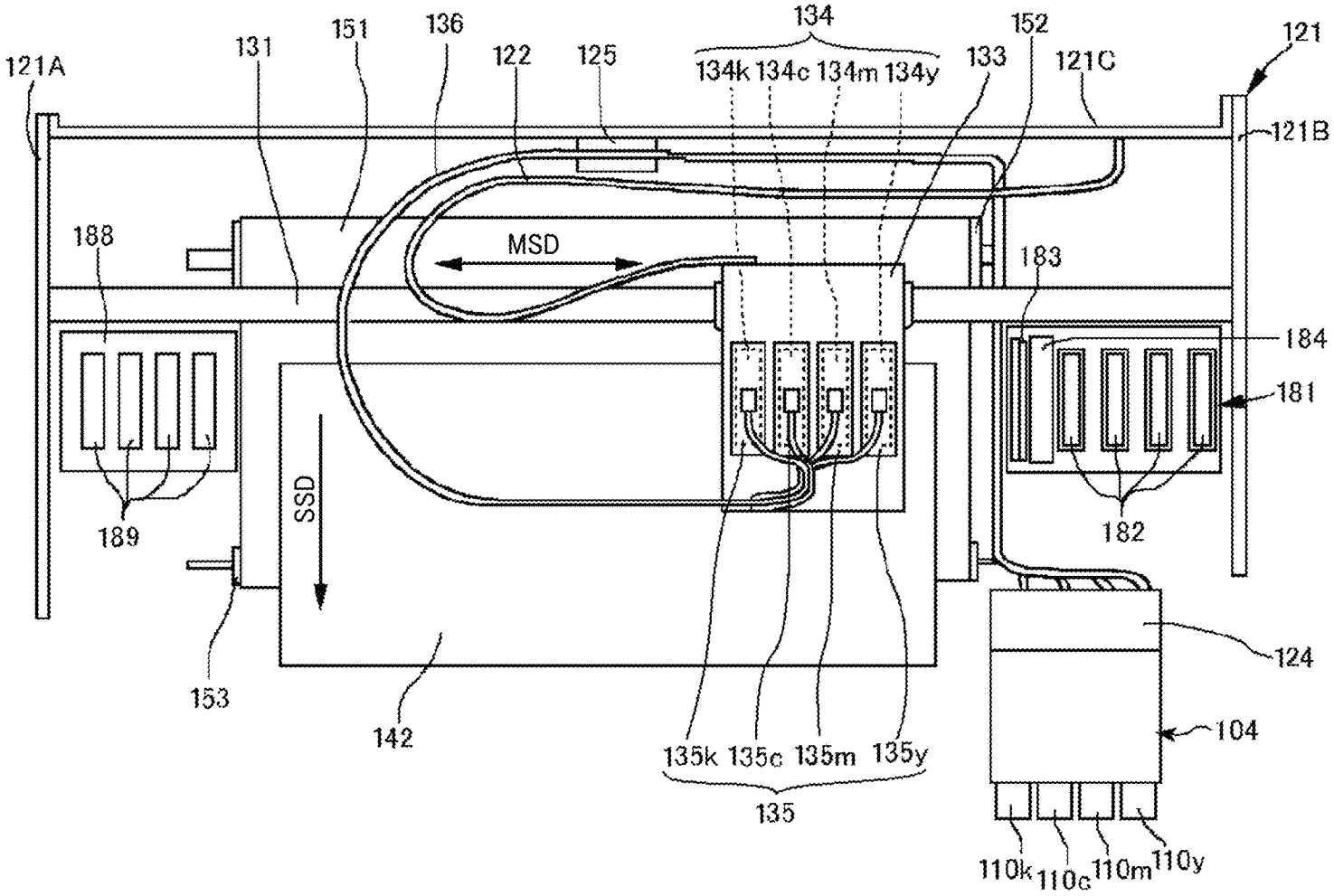
FIG. 12 is a plan view of a main portion of the mechanism portion of the inkjet recording apparatus of FIG. 10.

In the mechanism portion of the inkjet recording apparatus, a carriage 133 is slidably held in a main scanning direction (indicated by arrow "MSD" in FIG. 12) by a guide rod 131 that is a guide member laterally extending across left and right side plates 121A and 121B constituting the frame 121, and a stay 132, and is moved and scanned in a direction indicated by the arrow in FIG. 12 (carriage main scanning direction) via a timing belt by a known main scanning motor. The inkjet recording apparatus of the present embodiment is a serial image forming apparatus in which the recording head discharges the ink to form an image while being moved in the main scanning direction.

The recording head 134 including four liquid discharge heads for discharging ink droplets (droplets) of the respective colors of yellow (Y), cyan (C), magenta (M), and black (Bk) is attached to the carriage 133, arraying a plurality of ink discharge ports (nozzles) in a direction intersecting with the main scanning direction with an ink droplet discharge direction facing downward.

As the recording head 134, a head including a piezoelectric actuator such as a piezoelectric element, a thermal actuator using phase change due to film boiling of a liquid using an electrothermal transducer such as a heating resistor, a shape memory alloy actuator using metal phase change due to temperature change, or an electrostatic actuator using electrostatic force, as a pressure generator that generates a pressure for discharging the liquid droplets can be used.

A driver IC is mounted in the recording head 134 and is coupled to a known controller via a harness (flexible print cable) 122. In addition, the head tank 135 of the colors for supplying the inks of the respective colors to the recording head 134 is mounted on the carriage 133. The inks of the respective colors are supplied from the ink cartridges 110 of the respective colors loaded to the cartridge loader 104 to the head tank 135 of the colors via ink supply tubes 136 of the respective colors. The cartridge loader 104 includes a supply pump unit 124 for feeding the inks in the ink cartridges 110, and the ink supply tubes 136 are held with a locking member 125 in the middle of crawling on the rear plate 121C constituting the frame 121.

Meanwhile, as a paper feeder for feeding a recording paper (recording material) 142 stacked on a paper stacker (pressure plate) 141 of the paper feed tray 102, a semicircular roller (paper feed roller) 143 for separately feeding the recording papers 142 sheet by sheet from the paper stacker 141, and a separation pad 144 made of material having a larger friction coefficient and facing the paper feed roller 143 are provided, and the separation pad 144 is biased toward the paper feed roller 143.

Then, to feed the recording paper 142 fed from the paper feeder to a lower side of the recording head 134, a guide member 145 that guides the recording paper 142, a counter roller 146, a conveyance guide 147, and a pressing member 148 having a leading end pressing roller 149 are provided, and a conveyance belt 151 that is a conveyer for electrostatically absorbing the fed recording paper 142 and conveying the recording paper 142 at a position facing the recording head 134 is provided.

The conveyance belt 151 is an endless belt and is wound around a conveyance roller 152 and a tension roller 153 to circulate in a belt conveying direction (sub-scanning direction). The sub-scanning direction is indicated by arrow "SSD" in FIG. 12. In addition, a charging roller 156 for charging a surface of the conveyance belt 151 is provided. The charging roller 156 is arranged to come in contact with a surface layer of the conveyance belt 151 and rotates following rotation of the conveyance belt 151. Further, a guide member 157 is arranged corresponding to a printing area by the recording head 134 on a back side of the conveyance belt 151.

The conveyance belt 151 circulates in the belt conveying direction in FIG. 12 as the conveyance roller 152 is driven and circulates via a timing belt by a known sub-scanning motor.

Furthermore, as a paper ejector for ejecting the recording paper 142 recorded by the recording head 134, a separation claw 161 for separating the recording paper 142 from the conveyance belt 151, a paper ejection roller 162, and a paper ejection roller 163. The paper ejection tray 103 is provided below the paper ejection roller 162.

Further, a duplex unit 171 is detachably mounted on a back-side portion of the apparatus body 101. The duplex unit 171 takes in the recording paper 142 returned by reverse rotation of the conveyance belt 151, inverts the recording paper 142, and feeds the recording paper 142 again to between the counter roller 146 and the conveyance belt 151. A manual feed tray 172 is provided on an upper surface of the duplex unit 171.

Further, as illustrated in FIG. 12, a maintenance and recovery mechanism 181 including a recovery device for maintaining and recovering the state of the nozzles (ink discharge ports) of the recording head 134 is arranged in a non-printing area on one side in the scanning direction of the carriage 133.

The maintenance and recovery mechanism 181 includes cap members (caps) 182 for capping the nozzle surfaces of the recording head 134, a wiper blade 183 for wiping the nozzle surfaces, an idle discharge receiver 184 that receives droplets when idle discharge for discharging droplets that do not contribute to recording is performed to drain the thickened recording liquid, and the like. Here, the left-end one cap 182 in FIG. 12 is used as a suction and moisture retaining cap, and the other caps 182 are used as moisture retaining caps.

Then, a waste liquid of the recording liquid generated in maintenance and recovery operation by the maintenance and recovery mechanism 181, the ink drained to the cap 182, the ink attached to the wiper blade 183 and removed by a wiper cleaner 185, and the ink idly ejected to the idle discharge receiver 184 are drained to and accommodated in a known waste liquid tank.

Further, as illustrated in FIG. 12, an idle discharge receiver 188 that receives droplets when idle discharge for discharging the droplets not contributing to recording is performed to drain the thickened recording liquid during recording is arranged in the non-printing area on the opposite side of the maintenance and recovery mechanism 181. Openings 189 along a nozzle row direction of the recording head 134 are provided in the idle discharge receiver 188.

In the inkjet recording apparatus of the present embodiment configured as described above, the recording paper 142 is separately fed sheet by sheet from paper feed tray 102, is fed approximately vertically upward and guided by the guide member 145, is conveyed while being sandwiched between the conveyance belt 151 and the counter roller 146, is further guided with the leading end by the conveyance guide 147, is pressed against the conveyance belt 151 by the leading end pressing roller 149, and is changed in the conveying direction by approximately 90°.

At this time, a positive output and a negative output are alternately repeated, that is, an alternating voltage is applied from an AC bias supplier of the controller to the charging roller 156, and the conveyance belt 151 is charged in an alternating charge voltage pattern, that is, alternately charged plus and minus in a band manner with a predetermined width in the sub-scanning direction that is a circulating direction. When the recording paper 142 is fed onto the conveyance belt 151 alternately charged positive and negative, the recording paper 142 is absorbed by the conveyance belt 151 and is conveyed in the sub-scanning direction by circular movement of the conveyance belt 151.

Then, the recording head 134 is driven according to an image signal while the carriage 133 is moved in the main scanning direction on the basis of main scanning position information by a linear encoder 137 (FIG. 11), and the ink droplets are discharged onto the stopped recording paper 142 to record one line and then the next line is recorded after conveyance of the recording paper 142 by a predetermined amount. When a recording completion signal or a signal indicating that a tailing end of the recording paper 142 has reached a recording area is received, the recording operation is terminated, and the recording paper 142 is ejected onto the paper ejection tray 103.

Further, during standby for a printing (recording), the carriage 133 is moved to the maintenance and recovery mechanism 181 side, and the recording head 134 is capped with the caps 182 to keep the nozzles wet, thereby to prevent discharge failure due to ink drying. Further, in the state where the recording head 134 is capped with the caps 182, the recording liquid is sucked (nozzle suction/head suction) through the nozzles by a known suction pump to perform the recovery operation to drain the thickened recording liquid and air bubbles. Further, the idle discharge operation to discharge the ink not related to recording is performed before the start of recording, during recording, or the like. With the operation, the stable discharge performance of the recording head 134 is maintained.

Note that the image forming apparatus discharges the ink droplets through the nozzles of the recording head onto the recording material to form an image (recording, character printing, photographic printing, and printing are synonymous, and an act to impart an image having meaning of letters and figures to a medium and an act to impart an image having no meaning such as a pattern to the medium (liquid droplet discharge or liquid discharge that merely causes the droplets to land on the medium) are included).

The terms "image formation", "recording", "printing", "image printing", and "fabricating" used herein may be used synonymously with each other.

The present embodiment is also applicable to a three-dimensional modeling apparatus, a treatment liquid coating apparatus, an injection granulating apparatus, and the like, in addition to such an image forming apparatus.

Further, the material of the recording material is not limited to paper, and includes cloth, leather, metal, plastic, glass, wood, ceramics, and the like, to which droplets can be attached. The liquid discharged through the liquid discharge head is not limited to so-called ink and is not limited in particular as long as the liquid has viscosity and surface tension dischargeable through the head.

The liquid favorably has the viscosity of 30 mPa·s or less at an ordinary temperature and a normal pressure, or by being heated or cooled. More specifically, examples of the liquid include a solution, a suspension, and an emulsion containing a solvent such as water or an organic solvent, a colorant such as a dye or a pigment, a function-imparting material such as a polymerizable compound, a resin, or a surfactant, a biocompatible material such as DNA, an amino acid, protein, or calcium, and an edible material such as a natural pigment.

The liquid described-above can be used for inkjet inks, surface treatment liquids, liquids for forming constituent elements such as electronic elements and light emitting elements, and electronic circuit resist patterns, material liquids for three-dimensional shaping, and the like. The liquid discharge unit is an assembly of parts related to liquid discharge in which other functional parts and mechanisms are integrated with the liquid discharge head, and includes at least one of a carriage, a head tank, a liquid supply mechanism, and a maintenance and recovery mechanism, for example.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge unit comprising:

a main tank to accommodate a liquid;

a liquid discharge head to discharge the liquid;

a sub tank to supply the liquid to the liquid discharge head;

a first liquid supply channel connecting the main tank and the sub tank;

a second liquid supply channel connecting the sub tank and the liquid discharge head;

a selector valve disposed in the second liquid supply channel;

a liquid return channel connecting the selector valve and the main tank;

a first pump disposed in the first liquid supply channel to feed the liquid from the main tank to the sub tank; and a second pump disposed in the liquid return channel to feed the liquid from the sub tank to the main tank.

2. The liquid discharge unit according to claim 1, further comprising a filter disposed downstream of the selector valve in the second liquid supply channel in a direction in which the liquid is fed from the sub tank to the liquid discharge head.

3. The liquid discharge unit according to claim 1, further comprising a degassing module disposed downstream of the selector valve in the second liquid supply channel in a direction in which the liquid is fed from the sub tank to the liquid discharge head.

4. The liquid discharge unit according to claim 1, wherein at least one of the main tank and the sub tank includes an outflow port having a funnel shape on a downstream end of the at least one of the main tank and the sub tank.

5. The liquid discharge unit according to claim 1, wherein at least one of the main tank and the sub tank includes an agitator to agitate the liquid in the at least one of the main tank and the sub tank.

6. The liquid discharge unit according to claim 1, further comprising:

another selector valve disposed downstream of the first pump in the first liquid supply channel in a direction in which the liquid is fed from the main tank to the sub tank; and another liquid return channel connecting said another selector valve and the main tank.

7. The liquid discharge unit according to claim 1, further comprising:

a detector to detect a liquid amount in the sub tank, wherein, in response to detection of the liquid amount being greater than a threshold value, the selector valve is switched to open the liquid return channel and to close a channel from the selector valve to the liquid discharge head in the second liquid supply channel.

8. The liquid discharge unit according to claim 1, further comprising:

another selector valve disposed downstream of the first pump in the first liquid supply channel in a direction in which the liquid is fed from the main tank to the sub tank, said another selector valve including a plurality of ports, one of which is connected to the first pump;

a plurality of sub tanks respectively connected to remaining ports of the plurality of ports of said another selector valve; and a common liquid supply channel connecting the plurality of sub tanks and the selector valve.

9. An image forming apparatus comprising the liquid discharge unit according to claim 1.

* * * * *